US009561397B2

(12) United States Patent
Zaki

(10) Patent No.: US 9,561,397 B2
(45) Date of Patent: Feb. 7, 2017

(54) GRAB-AND-USE EXERCISE STRAP

(71) Applicant: Amir Zaki, Huntington Beach, CA (US)

(72) Inventor: Amir Zaki, Huntington Beach, CA (US)

( * ) Notice: Subject to any disclaimer, the term of this patent is extended or adjusted under 35 U.S.C. 154(b) by 0 days.

(21) Appl. No.: 15/080,143

(22) Filed: Mar. 24, 2016

(65) Prior Publication Data

US 2016/0206914 A1 Jul. 21, 2016

Related U.S. Application Data

(63) Continuation-in-part of application No. 13/297,010, filed on Nov. 15, 2011, now abandoned.

(Continued)

(51) Int. Cl.

| | |
|---|---|
| ***A63B 21/02*** | (2006.01) |
| ***A63B 21/00*** | (2006.01) |
| ***A63B 21/055*** | (2006.01) |
| ***A63B 23/02*** | (2006.01) |
| ***A63B 23/035*** | (2006.01) |

(52) U.S. Cl.

CPC ..... *A63B 21/4025* (2015.10); *A63B 21/0004* (2013.01); *A63B 21/00043* (2013.01); *A63B 21/00185* (2013.01); *A63B 21/0552* (2013.01); *A63B 21/4015* (2015.10);

(Continued)

(58) Field of Classification Search

CPC ..... A61H 1/02; A61H 1/0237; A61H 1/024; A61H 1/0244; A61H 1/0255; A61H 1/0259; A61H 1/0262; A61H 1/0266; A61H 1/0274; A61H 1/0277; A61H 1/0281; A61H 1/0285; A61H 2001/0248; A61H 1/0251; A61H 1/027; A63B 2023/006; A63B 23/0233; A63B 23/035; A63B 23/03508; A63B 23/03516; A63B 23/03525; A63B 23/03533; A63B 23/0355; A63B 21/0004; A63B 21/00043; A63B 21/00185; A63B 21/002; A63B 21/0023; A63B 21/00178; A63B 21/02; A63B 21/04; A63B 21/065; A63B 21/28; A63B 21/285; A63B 21/4001; A63B 21/4011; A63B 21/4013; A63B 21/4015; A63B 21/4017; A63B 21/4019; A63B 21/4021; A63B 21/4023; A63B 21/4025

See application file for complete search history.

(56) References Cited

U.S. PATENT DOCUMENTS 3,990,404 A * 11/1976 McNicoll ..... A01K 27/001 119/793
D311,232 S * 10/1990 Drennan ..... D21/692

(Continued)

*Primary Examiner* — Joshua Lee
(74) *Attorney, Agent, or Firm* — Plager Schack LLP

(57) ABSTRACT

An exercise apparatus with enhanced strength for use with one or more limbs of a user to perform a variety of exercises includes a resilient strap having a first end portion, a central portion and a second end portion, the first end portion of the strap coupled to the central portion of the strap to create a first loop, the first end portion being disposed around a top portion of the central portion of the strap and a bottom portion of the central portion of the strap, the second end portion of the strap coupled to the central portion of the strap to create a second loop, the second end portion being disposed around a remaining top portion of the central portion of the strap and a remaining bottom portion of the central portion of the strap. Each of the first and second loops can receive a user's limb.

7 Claims, 12 Drawing Sheets

Related U.S. Application Data

(60) Provisional application No. 62/486,449, filed on May 16, 2011.

(52) U.S. Cl.
CPC ..... *A63B 21/4019* (2015.10); *A63B 23/0233* (2013.01); *A63B 23/035* (2013.01); *A63B 23/03508* (2013.01)

(56) References Cited

U.S. PATENT DOCUMENTS 5,189,985 A * 3/1993 Brady ..... A01K 5/01 119/51.03
5,505,680 A * 4/1996 Keith ..... A63B 69/0071 482/148
5,518,481 A * 5/1996 Darkwah ..... A63B 21/0004 482/126
5,624,388 A * 4/1997 Lehr ..... A61F 5/0118 602/20
5,816,460 A * 10/1998 Cook ..... A45C 1/04 224/260
5,857,945 A * 1/1999 Papp ..... A63B 21/0004 482/121
5,921,903 A * 7/1999 Lawrence ..... A63B 23/0211 482/131
7,662,073 B1 * 2/2010 Baldwin ..... A63B 21/4001 482/139
D620,252 S * 7/2010 Keels ..... D3/247
7,854,231 B1 * 12/2010 Mostad ..... E05B 75/00 128/869
D631,924 S * 2/2011 Baldwin ..... D21/662
7,998,034 B1 * 8/2011 Cobo ..... A63B 69/0028 482/126
8,012,071 B2 * 9/2011 Grisdale ..... A63B 21/0004 482/122
8,033,728 B1 * 10/2011 Shatwell ..... B65D 33/1616 24/30.5 P
8,038,584 B1 * 10/2011 Pruessner ..... A61H 1/02 482/143
8,282,536 B2 * 10/2012 Latronica ..... A63B 21/16 482/121
D678,434 S * 3/2013 Hughes ..... D21/662
2004/0215114 A1 * 10/2004 Cruz ..... A61H 11/00 601/132
2005/0227814 A1 * 10/2005 Takemura ..... A63B 21/0004 482/44
2008/0132392 A1 * 6/2008 Moulton ..... A63B 21/0004 482/122
2010/0166993 A1 * 7/2010 Reese ..... D02G 3/28 428/36.1
2011/0281699 A1 * 11/2011 Torres ..... A63B 21/00043 482/131
2011/0306477 A1 * 12/2011 Keen ..... A63B 21/02 482/122

* cited by examiner

GRAB-AND-USE EXERCISE STRAP

RELATED APPLICATION

The application claims priority to non-provisional patent application U.S. Ser. No. 13/297,010 filed on Nov. 15, 2011, which claims priority to provisional patent application U.S. Ser. No. 61/486,449 filed on May 16, 2011, the entire content of which is herein incorporated by reference.

BACKGROUND

The embodiments herein relate to an apparatus for assisting body exercise, and more particularly to a ready-to-use exercise strap for body stretching, yoga poses and other dancing poses.

As yoga poses and exercises become more popular, body stretching as part of an exercise program has increased in recent years. For yoga practice, each yoga pose requires correct posture and stretching, mostly the proper placement of the arms and legs relative to the body's position. Body stretching is not an easy task for adults with rigid grown-up bodies. To achieve a good stretching effect on the muscles, a certain amount of resistance strength is also required.

As a result, there is a need for props or aides to safely and properly stretch in yoga, dance, gymnastics, strength training and physical therapy. One of the standard props is the yoga strap, which is around eight feet long with a metal or plastic buckle. This traditional strap is great for a couple of restorative stretches, but quite cumbersome and awkward for most others. One of the problems is that it is too long for most uses. The extra length gets in the way, twists and wraps around itself and the body, gets tangled, etc. The other big problem is the metal or plastic buckle. The buckle hurts when it comes in contact with one's hand or foot, and it makes a loud disturbing noise when it drops to a hard floor, disrupting peaceful yoga practices. During a stretching exercise, especially a yoga practice, it is one of the times of the day to quiet one's mind and body, and focus on one thing only. The last thing the user wants is to be disturbed by an exercise tool.

Other commercial endeavors have developed various complex tools. For example U.S. 2009/089459A1 describes a multi-functioning leg stretching device that includes a positioning seat, a retaining block, a winding around elastic strap, a pedal and an anchoring plate. However, it would not be easy to move this device around. U.S. 2005/0101461A1 describes a device with a built-in stretch resistance with latex tubes and pushup blocks. However, this device is bulky and a burden to use. A simpler design is found in U.S. 2005/0085350 A1, wherein an adjustable loop is connected to a handle by a swivel connector. However, this device is problematic because some individuals do not like handles and the disconnected handle in this device may get lost. An arm retention system for physical therapy is disclosed in U.S. Pat. No. 7,854,231, which comprises a strip having two loops. However, the junction of the loops has limited strength and/or durability, which restricts the use of the device when performing different exercises.

As such, there is a need in the industry for an exercise apparatus with enhanced strength and ease of use, which overcomes the limitations of the prior art.

SUMMARY

An exercise apparatus with enhanced strength for use with one or more limbs of a user to perform a variety of exercises is provided. The exercise apparatus is configured to enhance strength, stability and flexibility of the user. The exercise apparatus comprises a resilient strap comprising a first end portion, a central portion and a second end portion, the first end portion of the strap coupled to the central portion of the strap to create a first loop, the first end portion being disposed around a top portion of the central portion of the strap and a bottom portion of the central portion of the strap, the second end portion of the strap coupled to the central portion of the strap to create a second loop, the second end portion being disposed around a remaining top portion of the central portion of the strap and a remaining bottom portion of the central portion of the strap, wherein each of the first and second loops of the strap is configured to receive at least one limb of the user, thereby permitting the user to perform any one of the variety of exercises.

In certain embodiments, a method for enhancing strength, stability and flexibility of a user by performing a variety of exercises is provided. The method comprises providing an exercise apparatus to the user, inserting a first limb of the user through the first loop of the strap, inserting a second limb of the user through the second loop of the strap, and stretching the strap to a desired position to perform one of the variety of exercises.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

Figure 1:
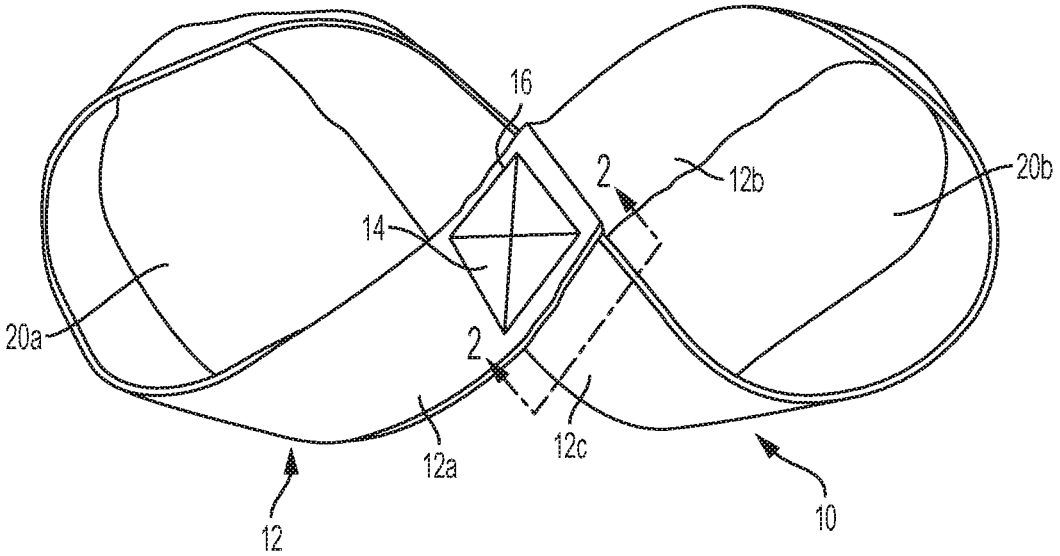
FIG. 1 depicts a perspective view of certain embodiments of the exercise apparatus.

The numerous innovative teachings of the present application will be described with particular reference to presently preferred embodiments (by way of example, and not of limitation). The present application describes several embodiments, and none of the statements below should be taken as limiting the claims generally.

For simplicity and clarity of illustration, the drawing figures illustrate the general manner of construction, and description and details of well-known features and techniques may be omitted to avoid unnecessarily obscuring the invention. Additionally, elements in the drawing figures are not necessarily drawn to scale, some areas or elements may be expanded to help improve understanding of embodiments of the invention.

The terms "first," "second," "third," "fourth," and the like in the description and the claims, if any, may be used for distinguishing between similar elements and not necessarily for describing a particular sequential or chronological order. It is to be understood that the terms so used are interchangeable. Furthermore, the terms "comprise," "include," "have," and any variations thereof, are intended to cover non-exclusive inclusions, such that a process, method, article, apparatus, or composition that comprises a list of elements is not necessarily limited to those elements, but may include other elements not expressly listed or inherent to such process, method, article, apparatus, or composition.

It is contemplated and intended that the design of exercise apparatus 10 applies to a heavy duty, highly durable fabric material that is of high resilient strength, for example, cotton, nylon or a hybrid material of nylon and rubber, which is stretchable, but only to an extent and stops stretching after that.

Figure 2:
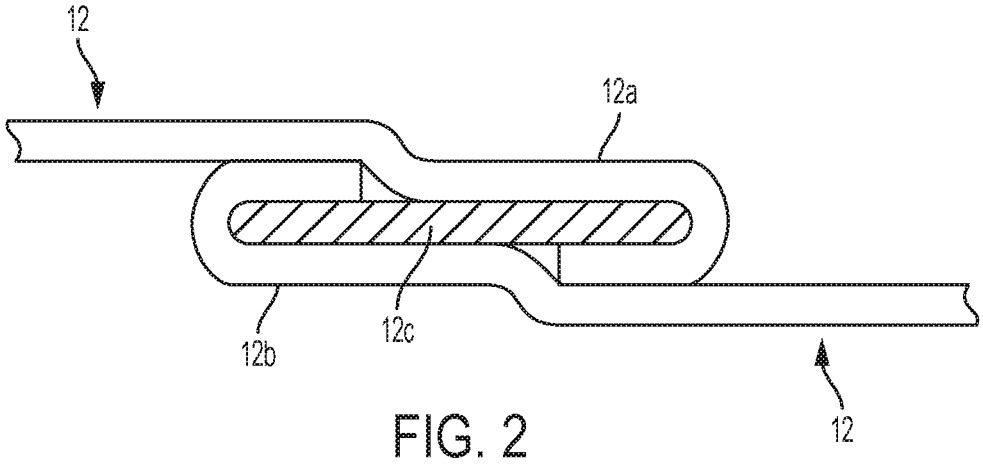
FIG. 2 depicts a cross-sectional view of certain embodiments of the exercise apparatus taken along line 2-2 in FIG. 1.
Figure 3A:
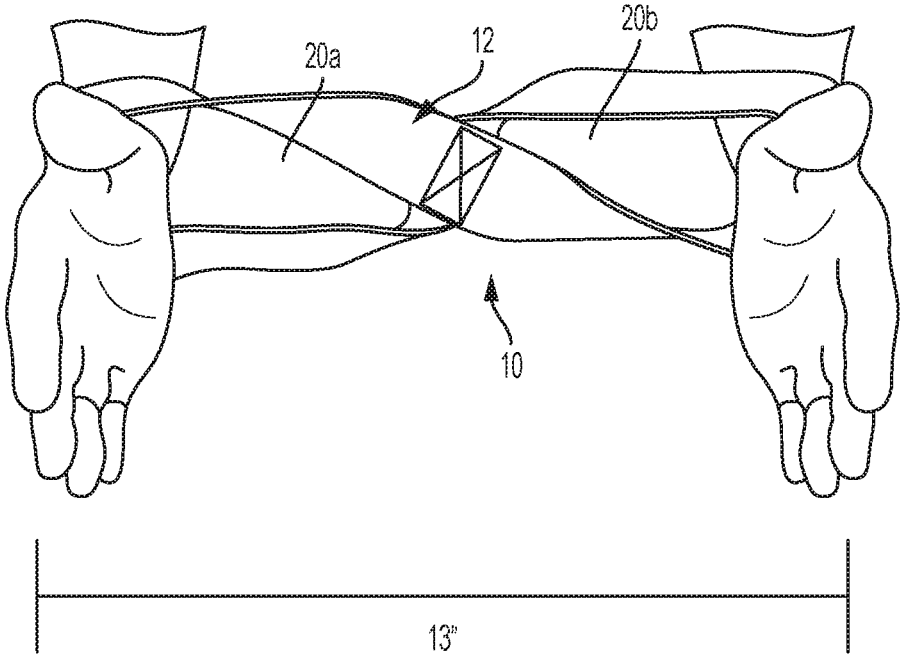
FIG. 3A depicts a perspective view of certain embodiments of the exercise apparatus.
Figure 3B:
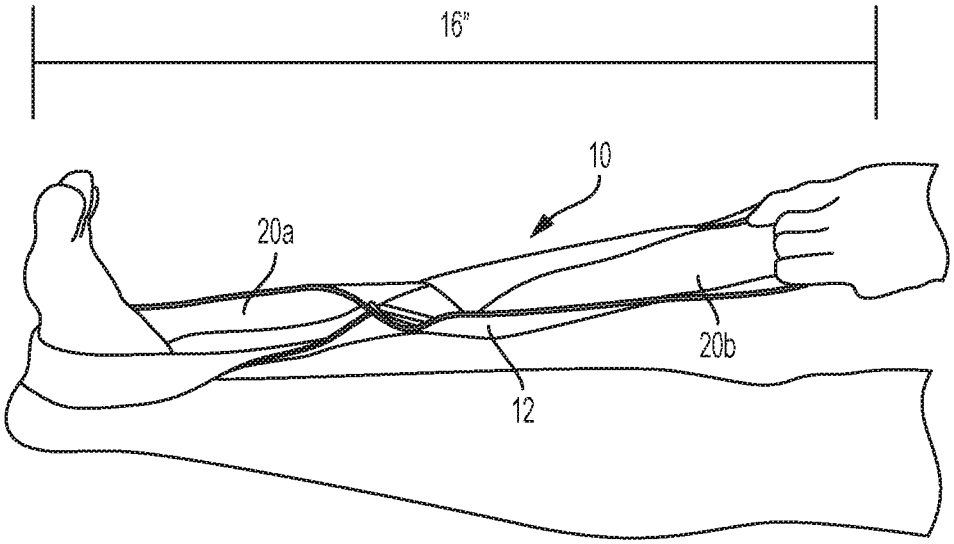
FIG. 3B depicts a perspective view of certain embodiments of the exercise apparatus.
Figure 3C:
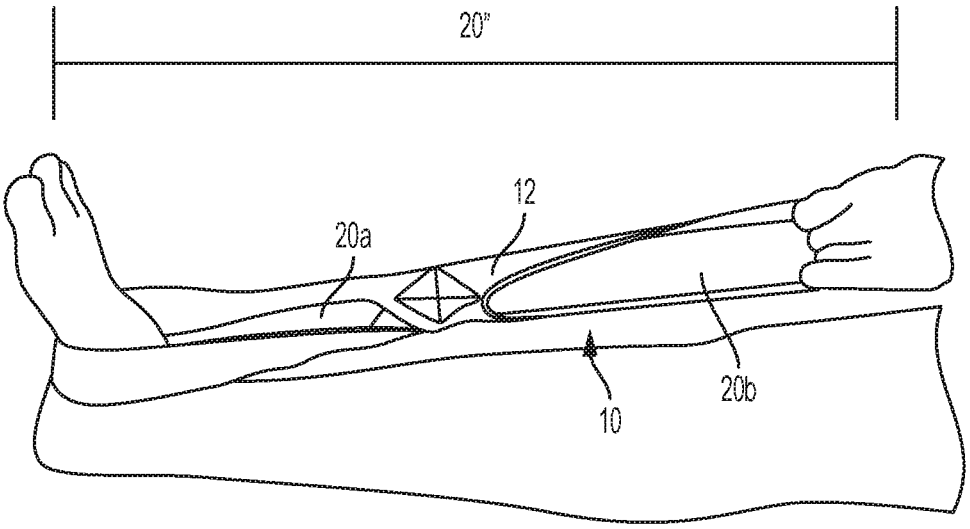
FIG. 3C depicts a perspective view of certain embodiments of the exercise apparatus.
Figure 3D:
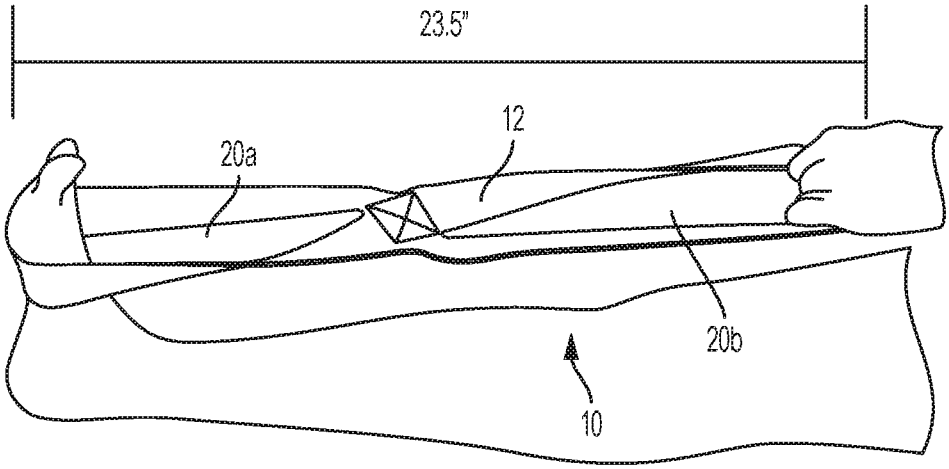
FIG. 3D depicts a perspective view of certain embodiments of the exercise apparatus.
Figure 3E:
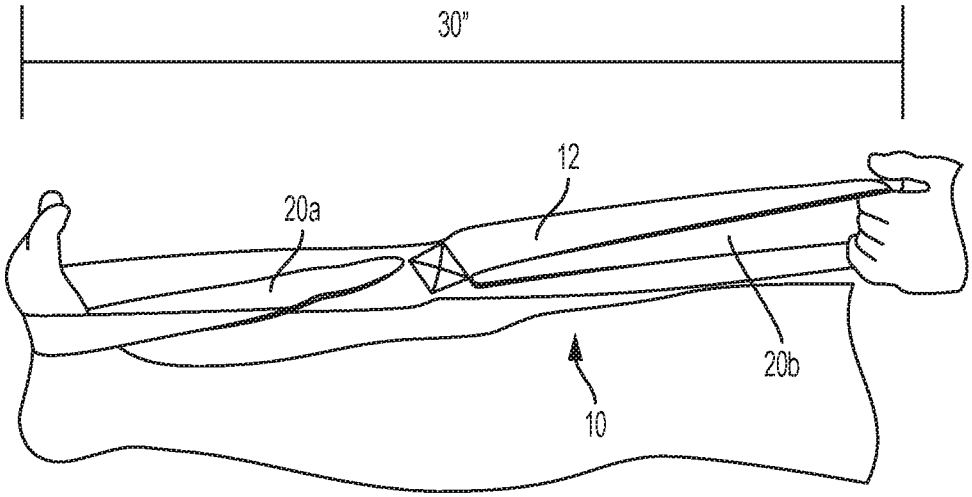
FIG. 3E depicts a perspective view of certain embodiments of the exercise apparatus.

In reference to FIGS. 1-2, an exemplary exercise apparatus 10 comprises a fabric strap 12 of 0.25-5 inches wide, 10-100 inches long, made of cotton, nylon or nylon/rubber hybrid material, or other durable fabrics. In a preferred embodiment, exercise apparatus 10 is approximately 1.5 inches wide and comprises outer nylon thread interwoven with latex strands and braided thereto. The ratio of materials in fabric strap 12 is approximately 80% nylon threads and 20% latex strands. This configuration creates an incredibly high resistance, limited elasticity in the strap with a maximum of 10-20% stretchability. Once the material has reached its maximum stretch, it completely stops and is prevented from stretching any further. The material of fabric strap 12 is rated to withstand 4000+ pounds before losing its integrity, which makes it incredibly durable and safe to support human weight and use.

Fabric strap 12 comprises first fabric end 12*a*, second fabric end 12*b* and center fabric portion 12*c*. First fabric end 12*a* and second fabric end 12*b* may be first twisted one hundred eighty degrees around a longitudinal axis of the fabric, forming a generally FIG. 8 shape having two loops with two ends meeting at a junction at an intermediate portion of fabric strap 12. In this configuration, fabric strap 12 forms first loop 20*a* and second loop 20*b*, which are inverted versions of each other. In a preferred embodiment, the junction where first fabric end 12*a* and second fabric end 12*b* are coupled is at center fabric portion 12*c*. However, it shall be appreciated that in alternative embodiments, center fabric portion 12*c* may not be the exact central point of fabric strap 12. The location of the junction on fabric strap 12 may vary depending on the needs of the user and size requirements of each loop 20*a*, 20*b*.

In reference to FIG. 2, the junction of the two loops 20*a*, 20*b* are fixed together with strong stitches or buttons (said button fixing 18 being shown in FIG. 6 hereinafter), which allows the resilient strength of each loop during a stretching exercise to be kept at its side and to be balanced with the other side. To provide a strong hold at the junction, first fabric end 12*a* may be affixed to center fabric portion 12*c* by being disposed around a top portion of center fabric portion 12*c* to a bottom portion of center fabric portion 12*c*. Second fabric end 12*b* may be affixed to center fabric portion 12*c* by being disposed around the remaining bottom portion of center fabric portion 12*c* to the remaining top portion of center fabric portion 12*c*.

In this configuration, the portion of first fabric end 12*a* disposed around the top portion of center fabric portion 12*c* is also in contact with a portion of second fabric end 12*b* of the strap. Similarly, the portion of second fabric end 12*b* disposed around the bottom portion of center fabric portion 12*c* is also in contact with a portion of first fabric end 12*a*. This coupling of first fabric end 12*a*, second fabric end 12*b* and center fabric portion 12*c* increases the strength and durability of exercise apparatus 10.

First fabric end 12*a*, second fabric end 12*b* and center fabric portion 12*c* may be affixed together with stitching 16 at location 14. Location 14 is preferably at the central point of fabric strap 12 along the length. However, in alternative embodiments, location 14 may be offset from the center point of fabric strap 12. In alternative embodiments, more than one section or pieces of straps may be used and combined or connected for variations in strength and design. Harder rubber-like fabrics may be connected with soft cotton fabrics to enhance bending and twisting, and overall esthetic elegance. In addition, multiple layers of fabrics may be used together for added resilient strength.

In reference to FIGS. 3A-3E, different sizes of exercise apparatus 10 may be used to match different strength needs. For example, small to medium sizes are proper for small to medium body size and fair body flexibility. Large and extra large sizes are proper for larger body frames and fair body inflexibility.

In operation, exercise apparatus 10 is configured to help a user to enhance flexibility, muscular stability and strength. Each loop 20*a*, 20*b*, is configured to receive at least one limb of the user, which may include a hand, foot, arm or leg. Typically, the user will insert one limb through loop 20*a* or 20*b*, and a second limb through the other remaining loop. In other embodiments, the user may insert a third limb in either loop 20*a* or 20*b*. In other embodiments, the user may insert an additional limb in either loop 20*a* or 20*b*. Once the desired number of limbs is inserted through loops 20*a*, 20*b* of exercise apparatus 10, the user stretches fabric strap 12 to a desired position. This permits exercise apparatus 10 to provide an extra reach for the user's body and allow a deeper, safer and more natural stretch. The high-resistance material of fabric strap 12 acts like an extension of the user's muscles, mimicking his/her properties by stretching with the body, then stopping at the limit. This is unlike all other elastic materials, which continue to stretch and provide limited stability to the user. In certain embodiments, the user may place center fabric portion 12*c* of fabric strap 12 against a portion of the user's body during the stretch. These areas of the user's body may include, but are not limited to, the bottom portions of the feet, the back or other areas.

Depending on the type of limb inserted through loops 20*a*, 20*b* of exercise apparatus 10, the user may achieve a different effect. For example, when gripping exercise apparatus 10 with the hand, gripping the strap allows for traction of the wrist, which provides an additional therapeutic benefit for the user. When exercise apparatus 10 is placed at the ball of the foot, the strap allows extra foot flexion and flexibility. When exercise apparatus 10 is placed above and across both knees, the strap creates pelvic and lower back stability, and protects the knees from injury. When exercise apparatus 10 is placed on both wrists, the strap allows the user to deepen his/her twisting stretches and increases shoulder flexibility. When exercise apparatus 10 is placed above and across both elbows, the strap provides shoulder girdle stability and creates shoulder girdle strength.

Figure 4:
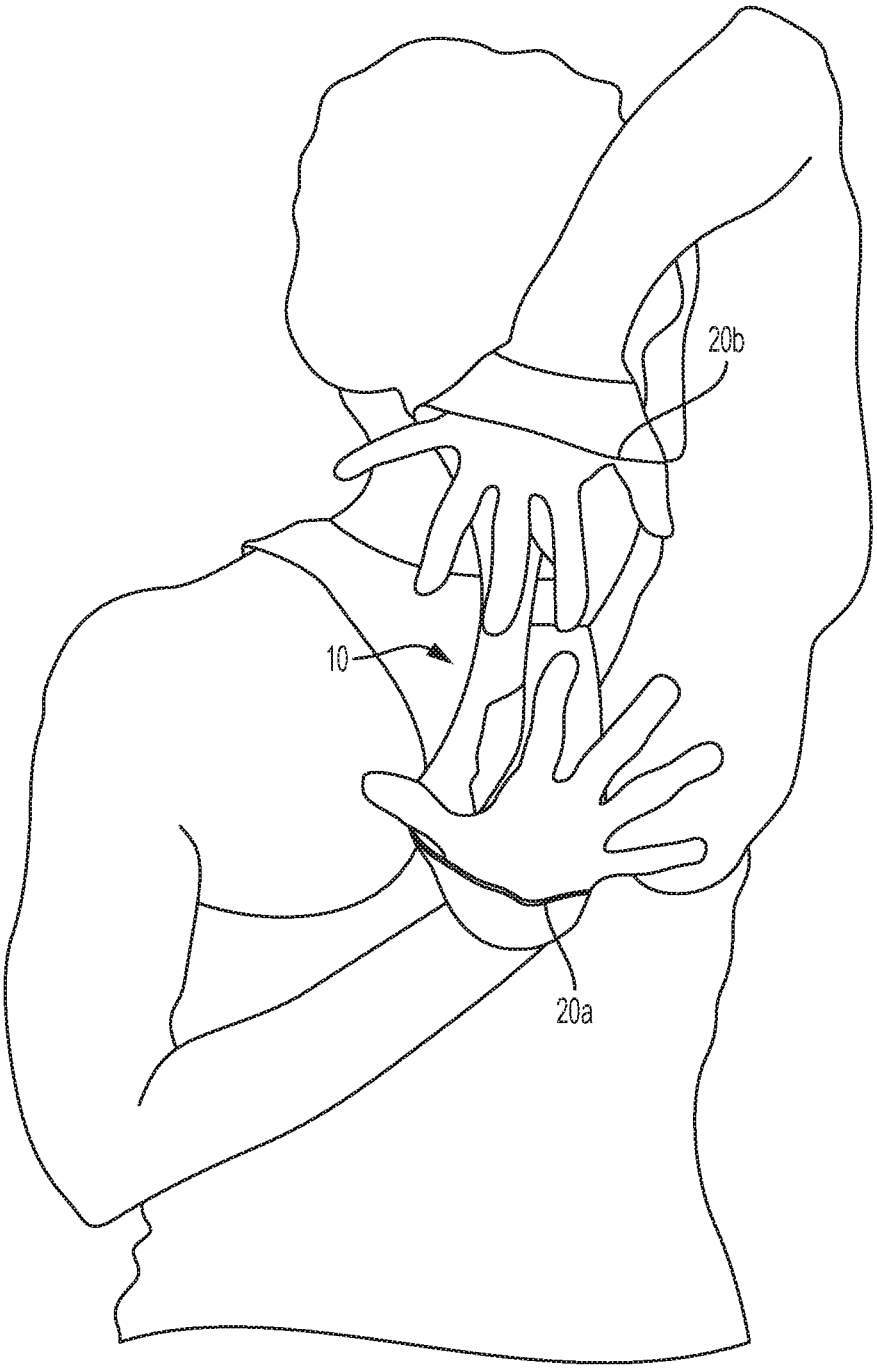
FIG. 4 depicts a perspective view of certain embodiments of the exercise apparatus shown in use.
Figure 5:
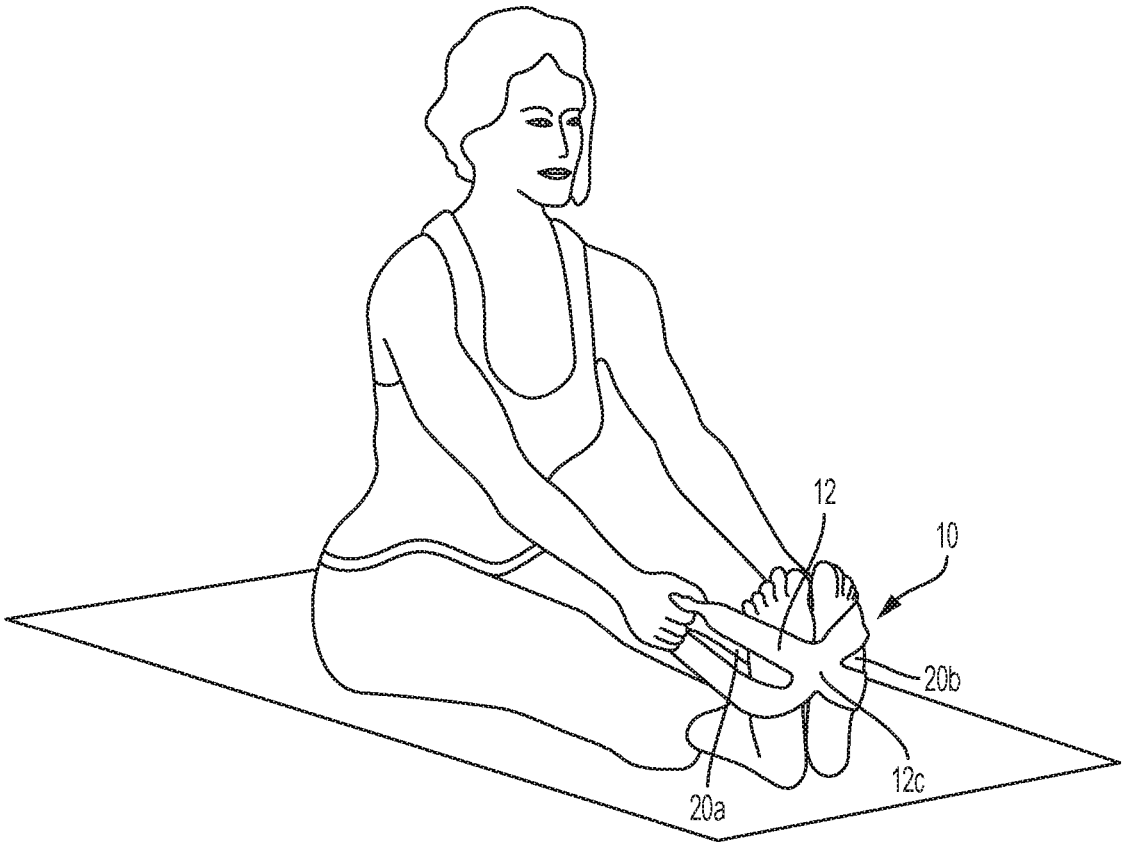
FIG. 5 depicts a perspective view of certain embodiments of the exercise apparatus shown in use.
Figure 6:
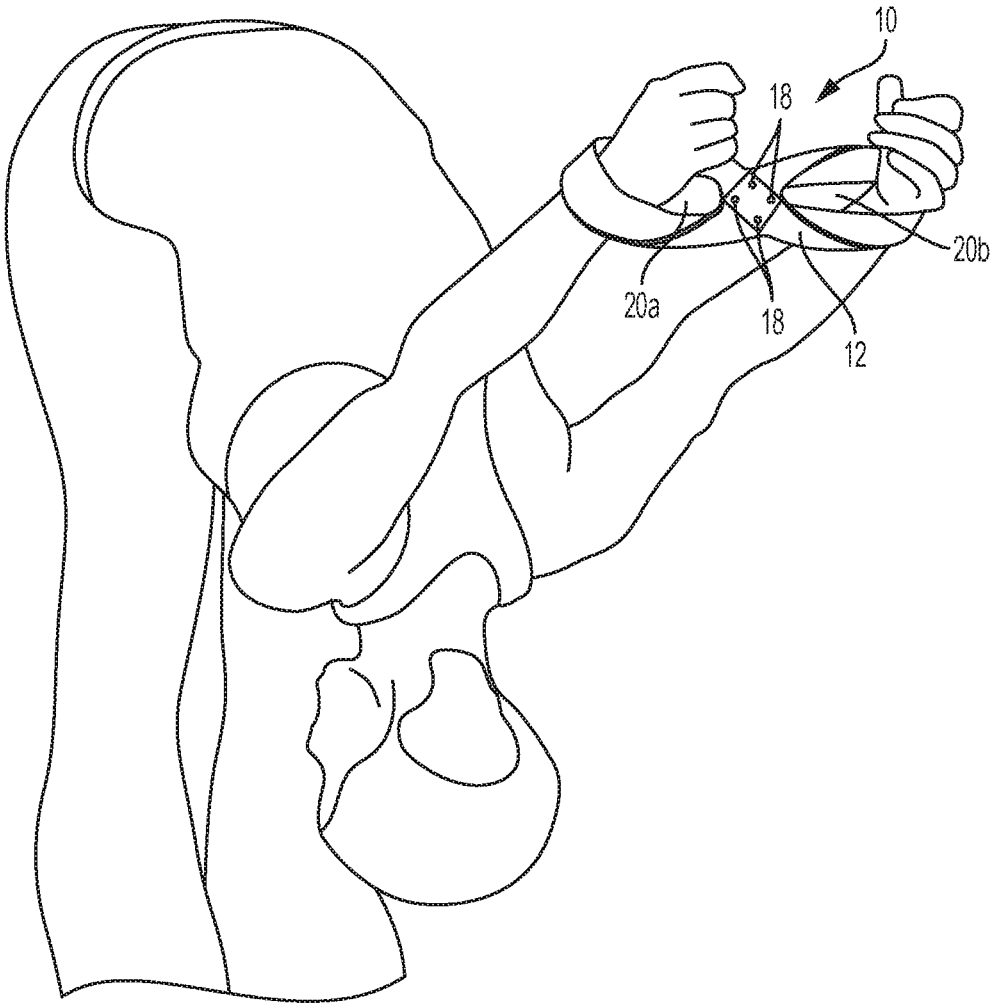
FIG. 6 depicts a perspective view of certain embodiments of the exercise apparatus shown in use.
Figure 7:
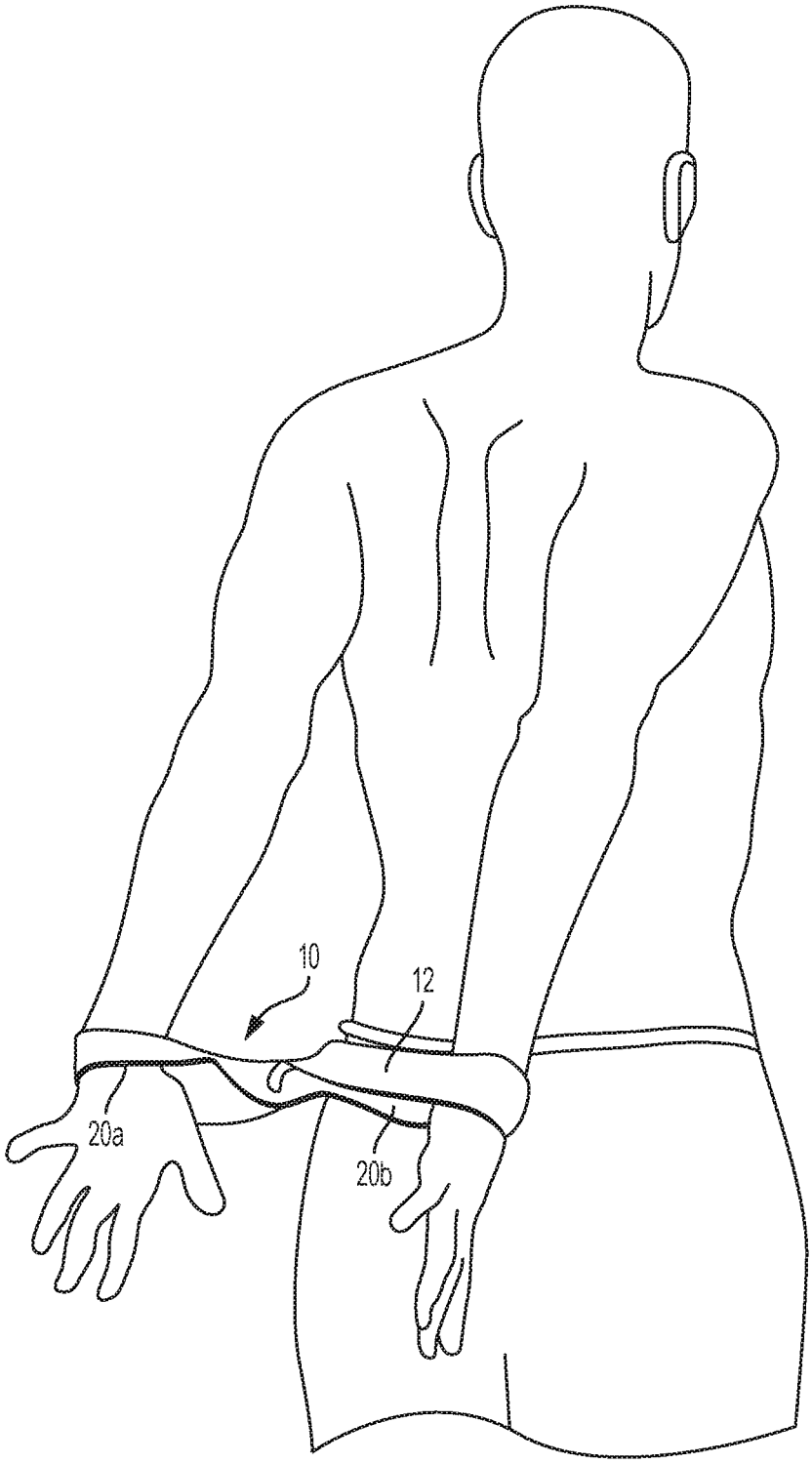
FIG. 7 depicts a perspective view of certain embodiments of the exercise apparatus shown in use.
Figure 8:
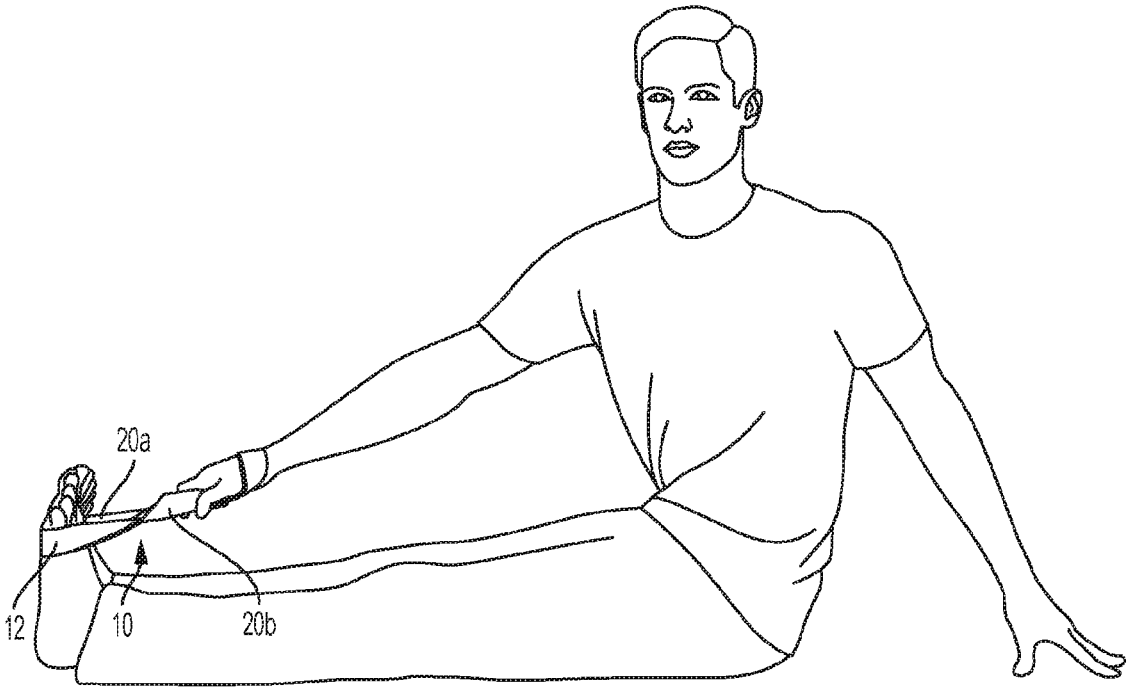
FIG. 8 depicts a perspective view of certain embodiments of the exercise apparatus shown in use.

In reference to FIGS. 4-8, several exemplary stretching postures are illustrated. FIG. 4 depicts a back stretch with wrists disposed through loops 20*a*, 20*b* and arms positioned behind the user's back. FIG. 5 depicts a hand and leg stretch with the user's hands grabbing loops 20*a*, 20*b* and center fabric portion 12*c* disposed against balls of the user's feet. FIG. 6 depicts a body stretch with the user's hands inserted through loops 20*a*, 20*b*. FIG. 7 depicts a shoulder stretch with the user's hands inserted through loops 20*a*, 20*b* and the arms positioned behind the back. FIG. 8 depicts a twist stretching routine with both feet disposed through loop 20*a* and one hand disposed through loop 20*b*.

It shall be appreciated that exercise apparatus 10 has several advantages. Because each loop always stays open, the design makes it easy to slip over one's hand or foot. The design also makes it very easy and natural to form a good grip, following the natural contours of the body. It distributes the pressure away from one's fingers more broadly over one's hand and wrist. The design structure is strong and durable. In certain embodiments, the straps may be made of heavy-duty natural cotton or nylon webbing that is pre-washed and available in any colors, or of high resistance nylon and rubber hybrid webbing material that stretches to a point and then stops, much like the way the human body stretches. Exercise apparatus 10 can be machine washed and dried. Also, since exercise apparatus 10 does not have any metal or plastic buckles or any other parts, the apparatus is very natural and easy to use, which eliminates set-up or assembly time. The apparatus is also very safe and quiet during use when it contacts a hard floor or any other surface. The apparatus does not easily get tangled or bunched up.

It shall be appreciated that the components of exercise apparatus 10 described in several embodiments herein may comprise any alternative known materials in the field and be of any color, size and/or dimensions. It shall be appreciated that the components of exercise apparatus 10 described herein may be manufactured and assembled using any known techniques in the field.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. An exercise apparatus with enhanced strength for use with one or more limbs of a user to perform a variety of exercises, the exercise apparatus configured to enhance strength, stability and flexibility of the user, the exercise apparatus comprising:

a resilient strap comprising a first end portion, a central portion and a second end portion, the first end portion of the strap affixed to the central portion of the strap to create a first loop, the first end portion disposed around a top portion of the central portion of the strap and affixed to a bottom portion of the central portion of the strap, the second end portion of the strap affixed to the central portion of the strap to create a second loop, the second end portion disposed around a remaining bottom portion of the central portion of the strap and affixed to a remaining top portion of the central portion of the strap, wherein each of the first and second loops of the strap is configured to receive at least one limb of the user, thereby permitting the user to perform any one of the variety of exercises.

2. The exercise apparatus of claim 1, wherein a portion of the first end portion of the strap disposed around the top portion of the central portion of the strap is in contact with the second end portion of the strap, wherein a portion of the second end portion of the strap disposed around the bottom portion of the central portion of the strap is in contact with the first end portion of the strap.

3. The exercise apparatus of claim 2, wherein the resilient strap comprises approximately 80% nylon threads and 20% latex strands, wherein the nylon threads are interwoven with the latex strands.

4. The exercise apparatus of claim 3, wherein the resilient strap comprises a maximum approximate stretchability range of 10-20%.

5. A method for enhancing strength, stability and flexibility of a user by performing a variety of exercises, the method comprising:

providing an exercise apparatus to the user, the exercise apparatus comprising:

a resilient strap comprising a first end portion, a central portion and a second end portion, the first end portion of the strap affixed to the central portion of the strap to create a first loop, the first end portion disposed around a top portion of the central portion of the strap and affixed to a bottom portion of the central portion of the strap, the second end portion of the strap affixed to the central portion of the strap to create a second loop, the second end portion disposed around a remaining bottom portion of the central portion of the strap and affixed to a remaining top portion of the central portion of the strap, wherein a portion of the first end portion of the strap disposed around the top portion of the central portion of the strap is in contact with the second end portion of the strap, wherein a portion of the second end portion of the strap disposed around the bottom portion of the central portion of the strap is in contact with the first end portion of the strap;

inserting a first limb of the user through the first loop of the strap;

inserting a second limb of the user through the second loop of the strap; and stretching the strap to a desired position to perform one of the variety of exercises.

6. The method of claim 5, further comprising inserting a third limb of the user through either the first loop or the second loop of the strap.

7. The method of claim 5, further comprising disposing the central portion of the strap against a portion of a body of the user.

* * * * *